US006681837B1

(12) United States Patent
Wu et al.

(10) Patent No.: US 6,681,837 B1
(45) Date of Patent: Jan. 27, 2004

(54) AIR RELEASING CHECK STRUCTURE OF METAL INJECTING MACHINE

(76) Inventors: Chi Yin Wu, 235 Chung-Ho Box 8-24, Taipei (TW); Hou Wang, 235 Chung-Ho Box 8-24, Taipei (TW); Chirn Shun Hsn, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/321,986

(22) Filed: Dec. 19, 2002

(51) Int. Cl.[7] ..... B22D 17/10
(52) U.S. Cl. ..... 164/312; 366/82; 164/900
(58) Field of Search ..... 164/113, 312, 164/900; 425/559, 562, 563; 366/81, 82, 75

(56) References Cited

U.S. PATENT DOCUMENTS 4,350,663 A * 9/1982 McAlister ..... 422/137
6,276,434 B1 * 8/2001 Kono ..... 164/312

* cited by examiner

*Primary Examiner*—Kuang Y. Lin

(57) ABSTRACT

An air releasing check structure of a metal injecting machine has a seat rod installed between a rear seat of a feeding screw rod and the extruding head at a front end of the front section. A periphery of the seat rod is enclosed by a check toggle. If the material to be ejected has bubbles so that it is not extruded effectively, the bubbles will flow to the exhausting grooves of the check toggle. Then the bubbles are drained out. Thereby, the bubbles in the material are vented out so that the material becomes dense. When the material becomes dense with high tension, the pressure of material will be greater than the force for buckling the elastic toggles so that the elastic toggles expand. As a result, the elastic toggle will further isolate the exhausting groove. Thereby, the material moves forwards to be ejected from the extruding head.

1 Claim, 4 Drawing Sheets

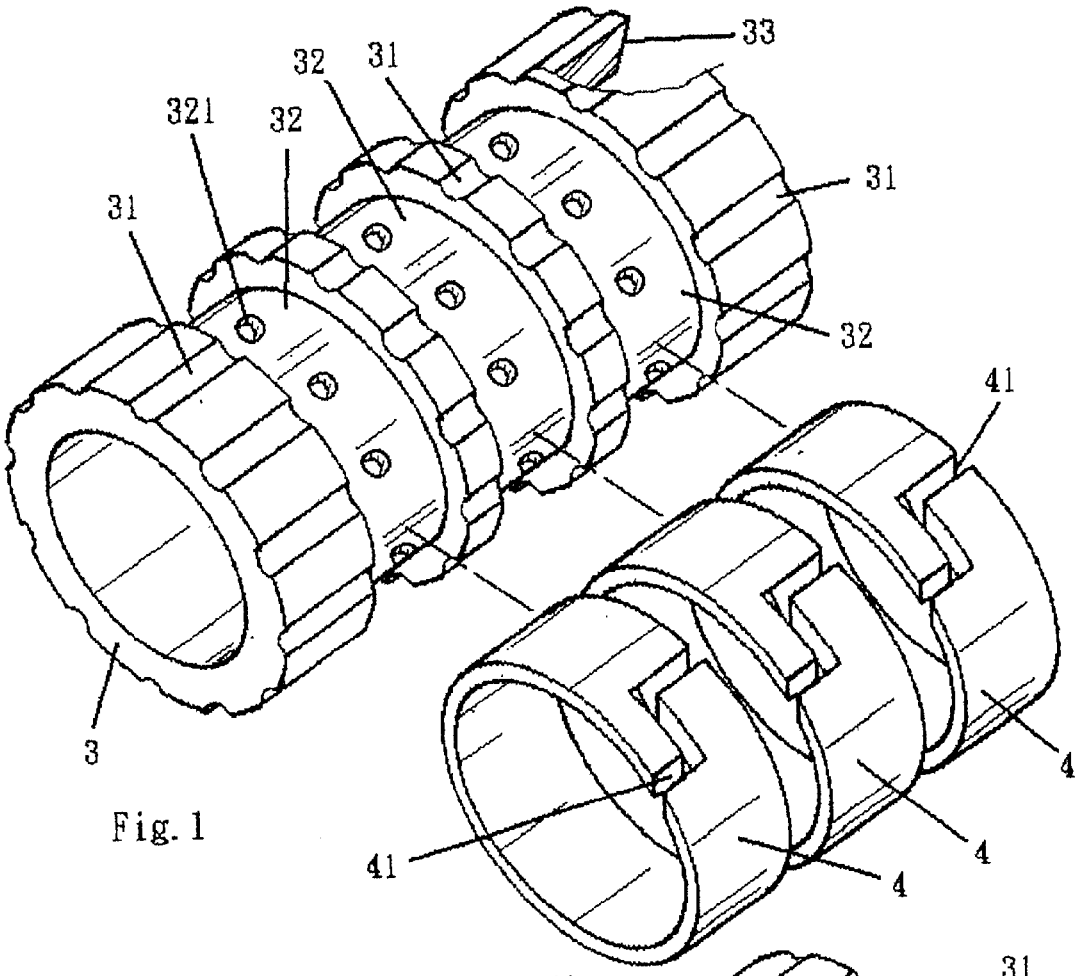
Fig. 1
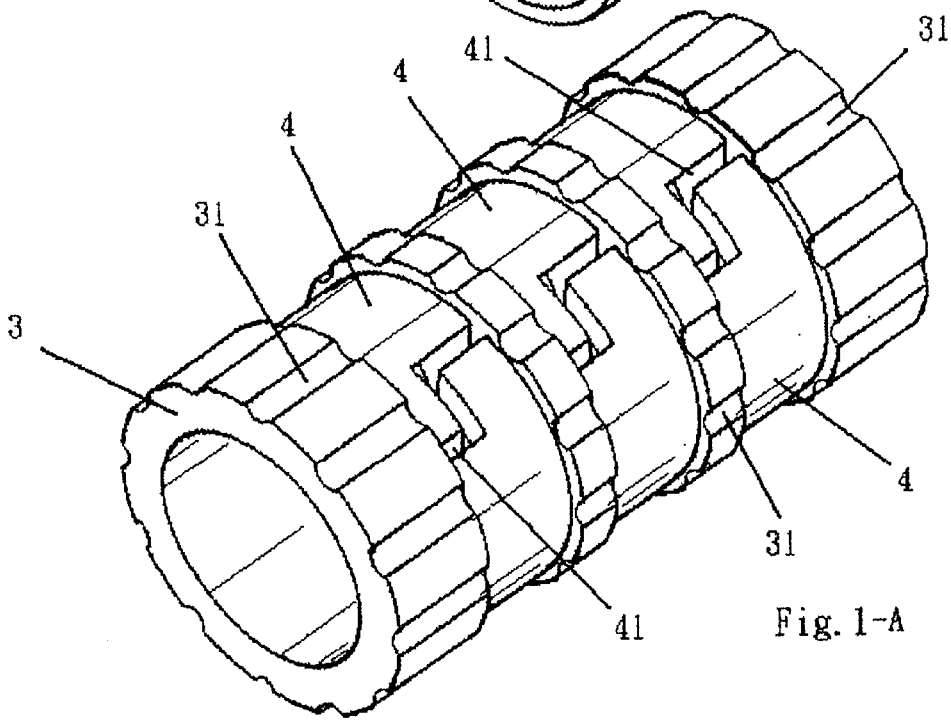
Fig. 1-A

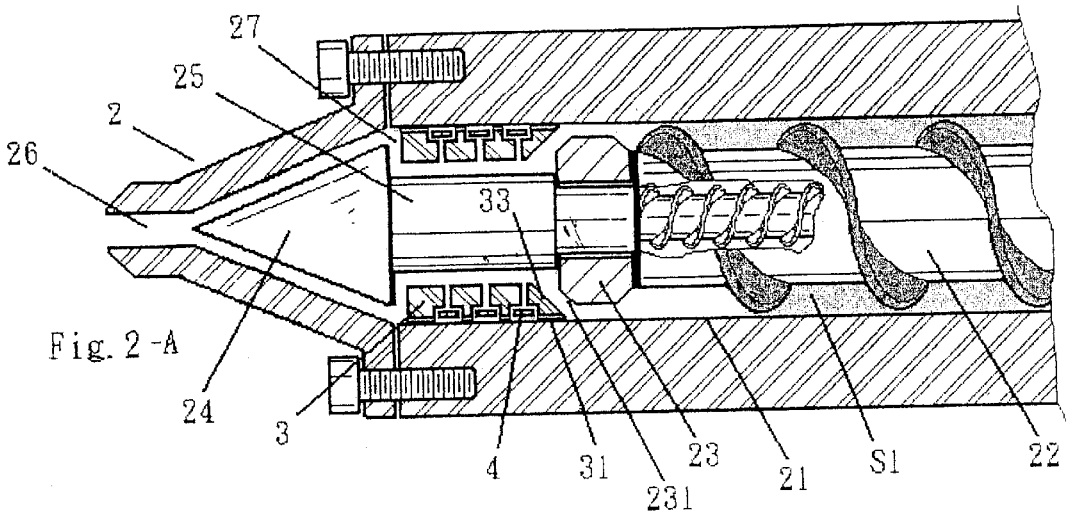
Fig. 2-A
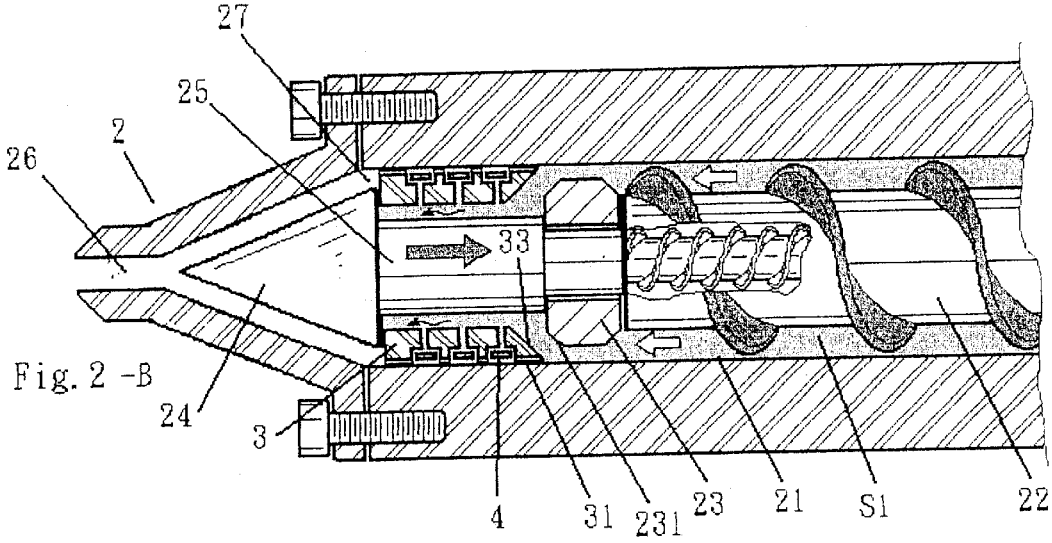
Fig. 2-B
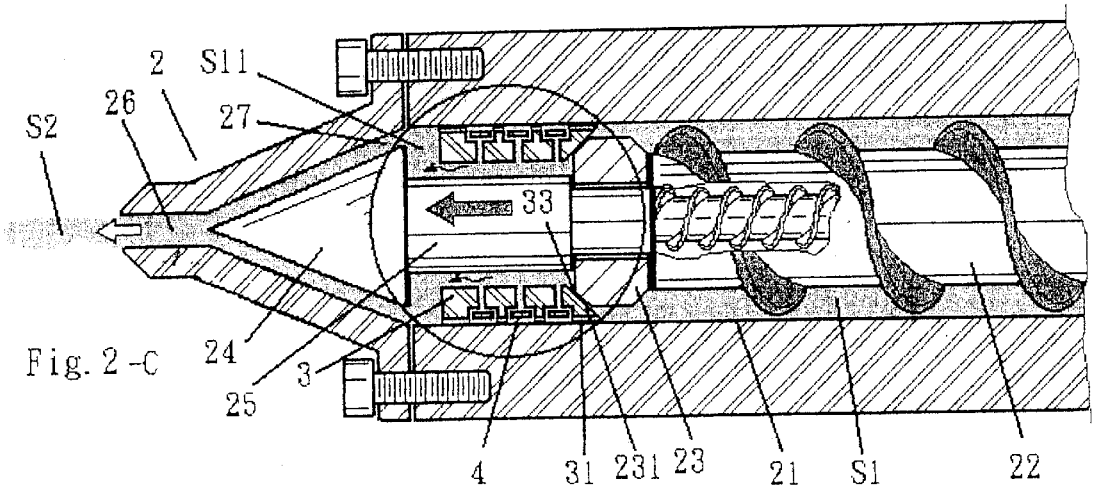
Fig. 2-C

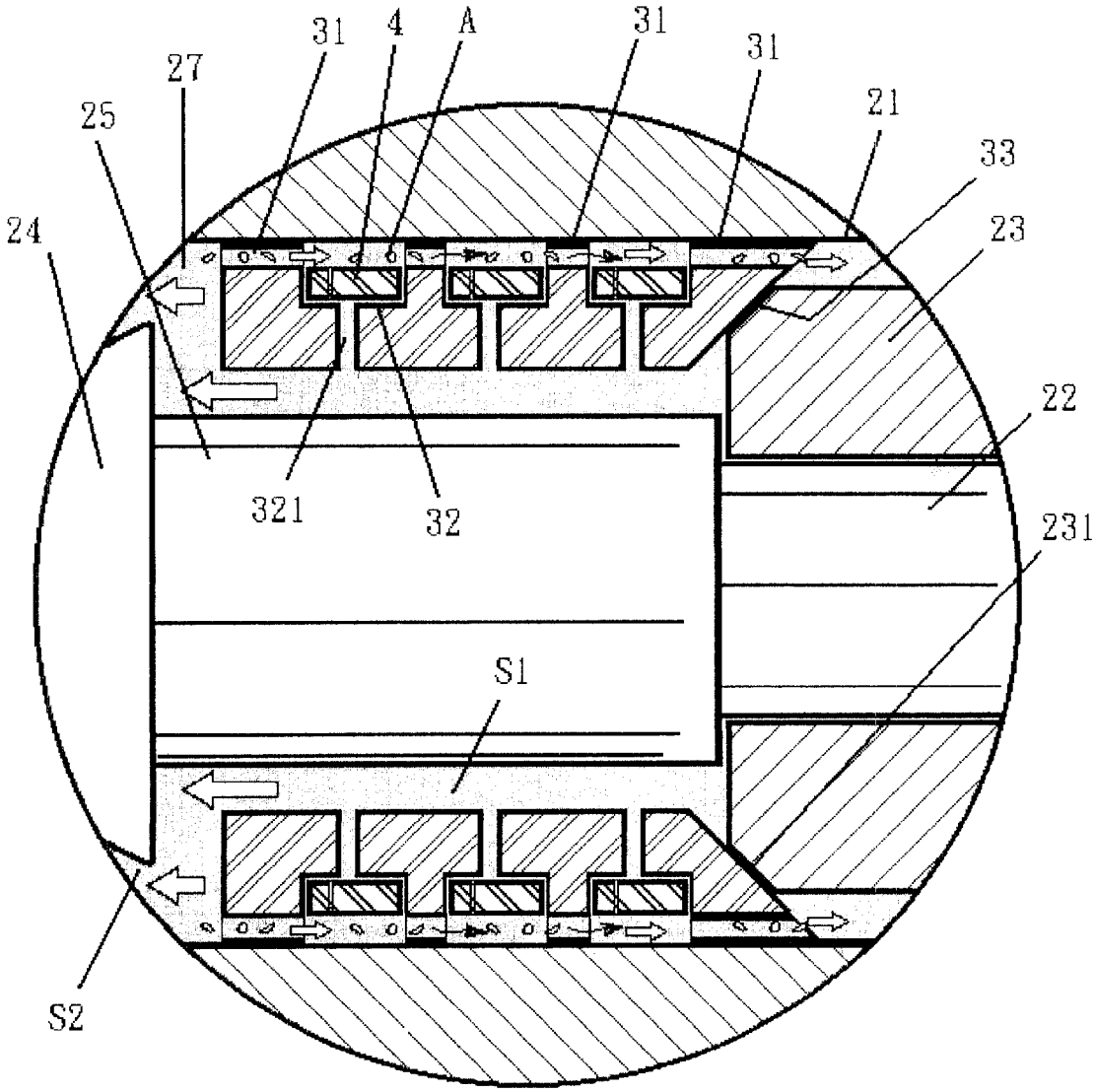
Fig. 3-A

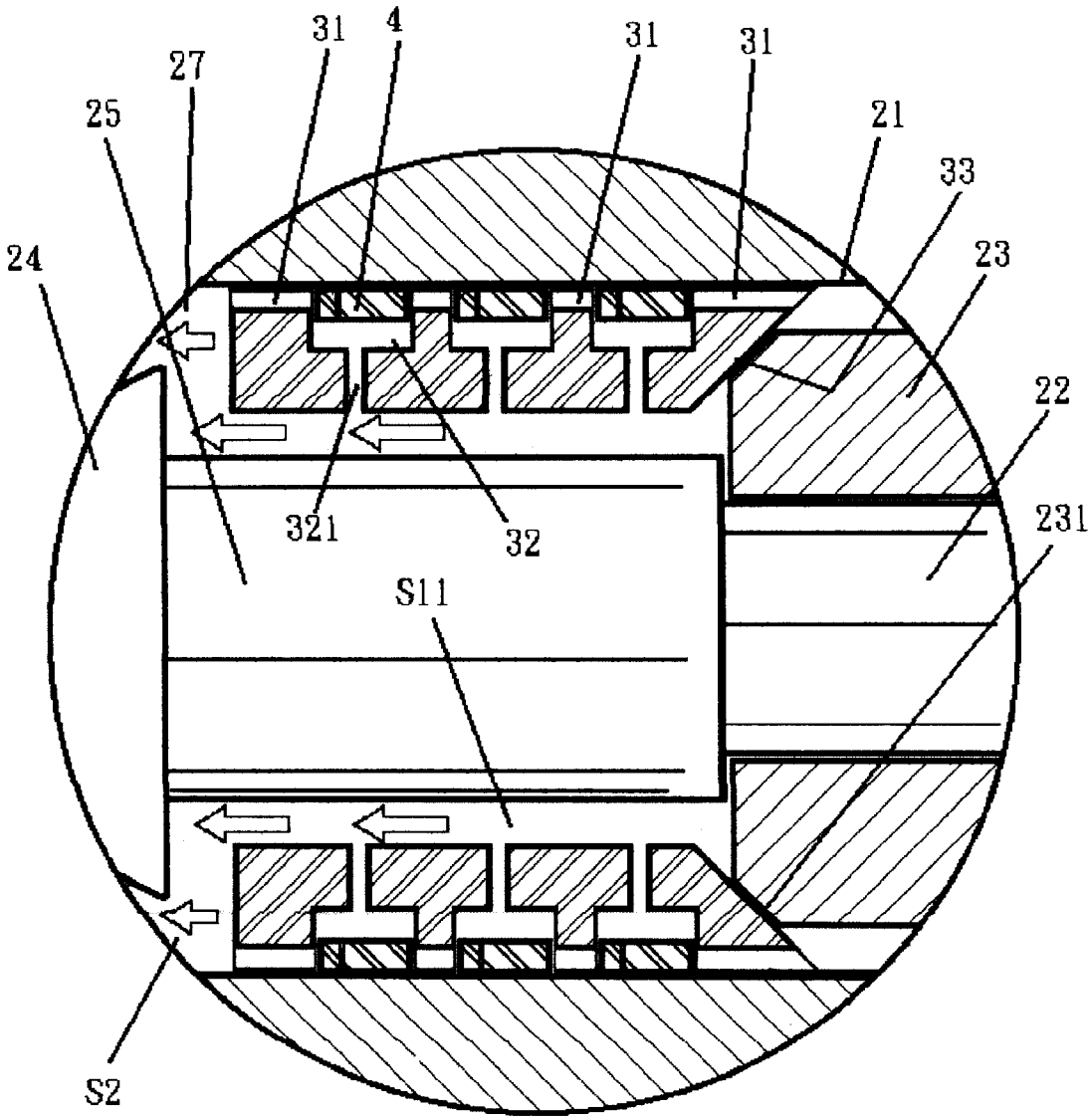
Fig. 3-B

AIR RELEASING CHECK STRUCTURE OF METAL INJECTING MACHINE

FIELD OF THE INVENTION

The present invention relates to metal injection machines; and particularly to an air releasing check structure of a metal injecting machine.

BACKGROUND OF THE INVENTION

Injecting machines are mainly used with shaping molds for forming products. Materials are heated and then extrude and thus feed to a mold. Conventionally plastic material is used due to low melting point, small particle sizes and preferred uniformity. Moreover, in the process of storage and injection, the material has no bubble therein.

Currently, many products, for example, computer casings, uses metals as material (for example, aluminum) for replacing plastic material. However, metals have high mass and density than plastics. Moreover, the particles of the metal after melting are not so uniform as plastic particles. Thereby, conventionally, a feeding screw rod with screw threads at the middle section is used to feed material, but this will induce bubbles to be accumulated in the metal material. As a result, the surface of the product is not uniform or gaps are formed in the wall of the product.

SUMMARY OF THE INVENTION

Accordingly, the primary object of the present invention is to provide an air releasing check structure of a metal injecting machine which has a seat rod. The seat rod is installed between a rear seat at a front section of a feeding screw rod and the extruding head at the front end in the feeding screw rod; a periphery of the seat rod being enclosed by a check toggle. If the material to be injected from the injecting mouth has bubbles so that it is not extruded effectively, the bubbles will flow to the exhausting groove of the check toggle. Then the bubble flows through an upper side of the contact surfaces of the first and second chamfered surfaces for draining out. Thereby, the bubbles in the material is vented out so that the material becomes dense. When the material becomes dense because of high pressure, the material flows to the toggle from the pressure releasing holes. For a longer time, the pressure of material will be greater than the force for buckling of the elastic toggles so that the toggles expand. As a result, a periphery of the toggle will press against a wall of the feeding groove; then the elastic toggle will further isolate the exhausting groove. Thereby, the material moves forwards to be injected from the extruding head.

The various objects and advantages of the present invention will be more readily understood from the following detailed description when read in conjunction with the appended drawing.

BRIEF DESCRIPTION OF THE DRAWINGS

FIG. 1 is an exploded perspective view and partial cross sectional view of the present invention.

FIG. 1A is an assembled perspective view of FIG. 1.

FIG. 2A shows a plane embodiment about the operation of the present invention.

FIG. 2B shows the operation of feeding material according to the embodiment of FIG. 2A.

FIG. 2C shows the operation of injecting material according to the embodiment of FIG. 2A.

FIG. 3A is an enlarged view of air exhausting of the present invention.

FIG. 3B is an enlarged view showing the operation of stopping air exhaustion operation.

BRIEF DESCRIPTION OF THE PREFERRED EMBODIMENTS

Referring to FIGS. 1, 1A and 2, in the present invention, a seat rod 25 is installed between a rear seat 23 at a front section of the feeding screw rod 22 and the extruding head 24 at the front end in the feeding screw rod 22. A periphery of the seat rod 25 is enclosed by a check toggle 3.

An annular periphery of the check toggle 3 is distributed with a plurality of longitudinal exhausting grooves 31. An outer surface of the check toggle 3 is slidably engaged to an inner surface of the feeding groove 21. At least one annular buckling groove 32 is formed around the periphery of the check toggle 3. A bottom of the buckling groove 32 is formed with a plurality of pressure releasing holes 321 which penetrate the bottom. The rear seat 23 is chamfered at two ends with chamfered surfaces 231 and the rear inner edge of the check toggle 3 is chamfered with chamfered surface 33. The chamfered surface 33 is configured to match the chamfered surface 231. When the check toggle 3 moves backwards, the chamfered surface 33 of the check toggle 3 will come to match and press against the chamfered surface 231 of the rear seat 23.

Each buckling groove 32 is enclosed by an elastic toggle 4. A thickness of the toggle 4 is smaller than a depth of the buckling groove 32 and is larger than a depth of the exhausting groove 31. The toggle 4 is rigid and an axial slit 41 is formed in the toggle 4.

By above device, when the feeding screw rod 22 move backwards, see FIG. 2A, material S1 is pushed forwards and the check toggle 3 is also pushed forwards. The two chamfered surfaces 231 and 33 are separated. Then an annular surface of the check toggle 3 will resist against a rear end surface of the extruding head 24. Thus material is hindered from moving forwards. Thereby, the material S1 enters into a periphery of the seat rod 25 and below the check toggle 3, see FIG. 2B.

When the feeding screw rod 22 moves forwards (referring to FIG. 2B), the material S1 is pushed forwards through the; extruding head 24 to the injecting mouth 26 as injecting material S2. Then due to counter reaction of the injecting material S2, the check toggle 3 will not move backwards. Then the two chamfered surfaces 231 and 33 contacts with one another (referring to FIG. 2C).

Referring to FIG. 3A, if the material S1 has bubbles A so that it is not extruded effectively, the bubbles will flow to the opening of the material outlet groove 27 and then flow to the exhausting groove 31 of the check toggle 3. Then the bubble flows through an upper side of the contact surfaces of the chamfered surfaces 231 and 33 for draining out. Thereby, the bubbles A in the material S1 is vented out so that the material S1 becomes dense.

Referring to FIG. 3B, when the material S11 generates a higher pressure as the material become dense. The pressure of the material S1 in the buckling groove 32 increase as the dense material S11 flowing into the buckling groove 32 through the releasing holes 321. After a short period of time, the tension of material S11 will be over the buckling force of the toggles 4 so that the toggles 4 expand. As a result, a periphery of the toggle 4 will eject a wall of the feeding groove 21. As a result, only a few, or even no bubble, exist in the material S11. The toggle 4 will further isolate the exhausting groove 31. Thereby, the material S11 moves forwards to be ejected from the extruding head 24 as injecting material S2.

Moreover, referring to drawings, the material for making the elastic toggles 4 depends on the material to be processed and thus can be varied. The number of the toggles 4 can also be varied.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An air releasing check structure of a metal injecting machine; a feeding screw rod being arranged within a feeding groove; material to be injected being filling in the feeding groove; a seat rod being installed between a rear seat at a front section of a feeding screw rod and an extruding head at a front end of the front section of the feeding screw rod; a periphery of the seat rod being enclosed by a check toggle; characterized in that:

an annular periphery of the check toggle is provided with a plurality of longitudinal exhausting grooves; an outer surface of the check toggle is slidably engaged to an inner surface of the feeding groove; at least one annular buckling groove is formed around the periphery of the check toggle; a bottom of the buckling groove is formed with a plurality of pressure releasing holes which penetrate the bottom; the rear seat is chamfered at a front end with first chamfered surface and a rear inner edge of the check toggle are chamfered with second chamfered surface; the second chamfered surface is configured to match the first chamfered surface;

each buckling groove is enclosed by an elastic toggle; a thickness of the elastic toggle is smaller than a depth of the buckling groove and is larger than a depth of the exhausting groove; each elastic toggle is rigid and an axial slit is formed in each of the elastic toggles;

wherein if the material to be ejected from the injecting mouth has bubbles so that it is not extruded effectively, the bubbles will flow to the exhausting grooves of the check toggle; then the bubbles flow through an upper side of the contact surfaces of the first and second chamfered surfaces for draining out; thereby, the bubbles in the material are vented out so that the material becomes dense; and when the material becomes dense, the material flows to the elastic toggle from the pressure releasing holes; for a longer time, the pressure of material will be greater than the force for buckling the elastic toggles so that the elastic toggles expand; as a result, a periphery of the toggle will press against a wall of the feeding groove; then the elastic toggle will further isolate the exhausting groove; thereby, the material moves forwards to be ejected from the extruding head.

* * * * *